US006915966B2

(12) United States Patent
Gist et al.

(10) Patent No.: US 6,915,966 B2
(45) Date of Patent: Jul. 12, 2005

(54) APPARATUS FOR THE GUNNING OF A REFRACTORY MATERIAL AND NOZZLES FOR SAME

(75) Inventors: Bernard D. Gist, Roseto, PA (US); Erwin Anton Letzgus, Jr., Somerset, NJ (US); Harold Harrison Gordon, Bangor, PA (US); William Joseph Peschler, Sayreville, NJ (US); John Anton Parkinson, Hazlet, NJ (US)

(73) Assignee: Specialty Minerals (Michigan) Inc., Bingham Farms, MI (US)

( * ) Notice: Subject to any disclaimer, the term of this patent is extended or adjusted under 35 U.S.C. 154(b) by 0 days.

(21) Appl. No.: 10/353,684

(22) Filed: Jan. 29, 2003

(65) Prior Publication Data

US 2004/0144859 A1 Jul. 29, 2004

(51) Int. Cl.[7] ..... B05B 1/28

(52) U.S. Cl. ..... 239/290; 239/291; 239/398; 239/424

(58) Field of Search ..... 239/290, 291, 239/292, 398, 406, 418, 416.4, 416.5, 417.5, 419.5, 424

(56) References Cited

U.S. PATENT DOCUMENTS

| | | | | | |
|---|---|---|---|---|---|
| 2,419,410 | A | | 4/1947 | Maurer | |
| 3,462,083 | A | | 8/1969 | Kautz | |
| 3,899,131 | A | | 8/1975 | Mester et al. | |
| 3,931,959 | A | | 1/1976 | Truman | |
| 4,094,946 | A | * | 6/1978 | Finkensiep et al. | 264/148 |
| 4,230,271 | A | | 10/1980 | Marcault | |
| 4,258,544 | A | * | 3/1981 | Gebhart et al. | 60/800 |
| 4,368,219 | A | * | 1/1983 | Nagata et al. | 427/236 |
| 4,370,944 | A | * | 2/1983 | Nagata et al. | 118/302 |
| 4,638,945 | A | | 1/1987 | Toda et al. | |
| 4,779,798 | A | | 10/1988 | Natolino et al. | |
| 4,981,731 | A | | 1/1991 | Yorita et al. | |
| 5,188,290 | A | * | 2/1993 | Gebauer et al. | 239/3 |
| 5,452,856 | A | * | 9/1995 | Pritchard | 239/297 |
| 5,628,940 | A | | 5/1997 | Allison | |
| 5,766,689 | A | | 6/1998 | Ono | |
| 5,795,594 | A | * | 8/1998 | York et al. | 424/489 |
| 5,869,145 | A | | 2/1999 | Iwasaki et al. | |
| 5,976,632 | A | * | 11/1999 | Gerber et al. | 427/426 |
| 5,979,798 | A | | 11/1999 | Hall et al. | |
| 6,217,654 | B1 | | 4/2001 | Mauchle et al. | |
| 6,277,446 | B1 | | 8/2001 | Tanaka et al. | |
| 6,613,307 | B1 | * | 9/2003 | Cooper | 424/45 |
| 2002/0132057 | A1 | | 9/2002 | Motoki et al. | |

FOREIGN PATENT DOCUMENTS

| | | | |
|---|---|---|---|
| EP | 1 223 399 | A1 | 7/2002 |
| JP | 356087450 | A * | 7/1981 |
| JP | 10316478 | A | 5/1997 |
| JP | 2000356475 | A | 6/1999 |
| SU | 1666195 | A1 * | 7/1991 |

OTHER PUBLICATIONS

"Refractory Shotcrete—Current State–of–the–Art", I. Leon Glassgold, *Shotcrete Classics*, Summer 2002, pp. 24–32.

* cited by examiner

*Primary Examiner*—William E. Tapolcai
*Assistant Examiner*—Mohammad M. Ali
(74) *Attorney, Agent, or Firm*—Michael J. Herman

(57) ABSTRACT

An apparatus for the gunning of a material is provided having a nozzle with an inner passage having an inlet end into which a wetted material is to be introduced and an outlet end from which the material is to be sprayed. An outer passage is disposed around the inner passage and in fluid communication therewith and has an inlet end for introducing a gas to be passed through the outer passage and impinged on the wetted material passing through the inner passage. Also provided is an apparatus for the gunning of a material having a material delivery hose for providing a material. A water inlet in fluid communication with the material delivery hose provides water to wet the material and a nozzle outputs the wetted material. A mixing chamber is disposed intermediate and in fluid communication with the material delivery hose and the nozzle and has at least one inlet for introducing a mixing gas.

15 Claims, 4 Drawing Sheets

APPARATUS FOR THE GUNNING OF A REFRACTORY MATERIAL AND NOZZLES FOR SAME

FIELD OF THE INVENTION

The present invention relates to an apparatus for applying material and more particularly to a gunning device for gunning monolithic refractories.

BACKGROUND OF THE INVENTION

Gunning devices that project a material onto a target substrate for producing or repairing of refractory linings are generally known. Two widely used gunning methods for fabricating and repairing refractory linings are known as the gunnite-type and shotcrete-type gunning methods. Unlike other casting methods, these gunning methods require no framework for casting refractory linings and allow for easy application even on irregular shapes or where frameworking is difficult to construct. Accordingly, gunning methods have been widely used in fabricating and repairing refractory linings, particularly, in furnaces such as a blast furnace, hot stove, electric furnace, converter, ladle, tundish, basic oxygen furnace and reheating furnace.

In a gunnite method, a dry powdery material to be "gunned" is pneumatically fed through a transporting hose to a nozzle assembly where water is added to produce a wet, highly viscous gunning material with good adhesive properties. The gunning material is projected through the nozzle assembly so that the material adheres and cures on the furnace wall portion, whereby a refractory furnace lining is fabricated or repaired. The gunnite application method requires no premixing of material with water and can therefore be carried out rapidly and on short notice and clean-up of equipment is minimal. An additional advantage over other methods of fabricating or repairing furnace linings include not having to use a lining mold, thereby enabling cost reduction and improving working efficiency and enables the repair of both hot and cold furnace linings. However, one disadvantage of the gunnite method is that it is difficult to completely wet and thoroughly mix the material and water stream as it is transported through the application gunning lance, pipe or nozzle. This is particularly true for short (less than about 5 feet) gunning pipes. In these situations, a lack of thoroughness in mixing results in less than optimum and desirable applied mass homogeneity and density, an increase in material waste due to rebounding aggregate and poor mass adhesion and often excessive material pipe drip. Additionally, when a directional change in the flow of the gunning material is required, the material tends to exit the nozzle in a "split" non-homogenous stream where part of the stream is very dry while the other part is overly wet, a phenomenon that is independent of any attempted water control. A problem associated with an overly dry or poorly wet gunning material that is gunned onto the object target, is that a portion of the material does not adhere to the substrate and causes a loss of deflected particles (known as "rebound") which lowers the adhesion percentage of the gunning material to the furnace wall, thus affecting the quality and durability of a refractory furnace mass. To overcome the problems associated with nozzle gunning methods, shotcrete-gunning methods were developed.

Shotcrete gunning methods produce refractories having a more uniform quality and better physical properties than obtained by the gunnite method and generally are used for producing high density, monolithic structures. In the shotcrete method, a gunning material is produced by mixing a dry material with water in a separate mixing device prior to delivery to a gunning device. The dry powdery material is pre-wet with water in a mixer and then pumped by a delivery pump through a transfer hose to a gunning device which projects the gunning material to a target using compressed air. Usually, a setting agent is added to the gunning material at the nozzle prior to the gunning material being projected onto a furnace wall structure.

The shotcrete gunning method is not without its attendant drawbacks, however, in that it is necessary to mix the dry material with water in a separate vessel until a suitable consistency is obtained. Thus, a shotcrete gunning material is mixed before it is supplied by the delivery pump to a gunning device requiring additional equipment, e.g., mixer and delivery systems, and manpower, when compared with the nozzle gunning method. Moreover, it is important to accurately control the amount of water to the gunning material in the shotcrete gunning method to maintain the proper consistency. As a result, skill on the part of the shotcrete-gunning operator is required to maintain the correct amount of water for a desirable composition. If too little water is used, blocking or premature hardening of the gunning material may occur in the pump or delivery hose. Conversely, if an excessive amount of water is used, there can occur separation of aggregates of coarse particles and fine powder which is contained in the gunning material to be sprayed causing uneven and poor quality refractory layers.

An additional disadvantage of the "shotcrete" method is the logistics of the mixer and pump. A certain amount of gunning material remains in the delivery hose and nozzle creating a waste of material and increased manpower costs for the emptying and cleaning of equipment.

Furthermore, unlike the gunnite application method, which can be employed in hot applications to repair furnace walls at elevated temperature (e.g., above 2000 degrees Fahrenheit), attempts at using the shotcrete gunning method for repairing refractories at high temperatures have not been very successful.

The foregoing illustrates limitations known to exist in present refractory coating methods and devices. Thus it is apparent that it would be advantageous to provide an alternative directed to overcoming one or more of the limitations set forth above. Accordingly an alternative apparatus for the gunning of a material is provided including the features more fully disclosed hereinafter.

SUMMARY OF THE INVENTION

According to the present invention, an apparatus for the gunning of a material is provided having a nozzle with an inner passage having an inlet end into which a wetted material is to be introduced and an outlet end from which the material is to be sprayed. An outer passage is disposed around the inner passage and in fluid communication therewith and has an inlet end for introducing a gas to be passed through the outer passage and impinged on the wetted material passing through the inner passage, thus constricting the material as it exits the nozzle.

Also provided is an apparatus for the gunning of a material having a material delivery hose for providing a material. A water inlet in fluid communication with the material delivery hose provides water to wet the material and a nozzle outputs the wetted material. A mixing chamber is disposed intermediate and in fluid communication with the material delivery hose and the nozzle and has at least one inlet for introducing a mixing gas.

The foregoing and other aspects will become apparent from the following detailed description of the invention when considered in conjunction with the accompanying drawing figures.

BRIEF DESCRIPTION OF THE DRAWINGS

Novel features and advantages of the present invention will become apparent to those skilled in the art from a reading of the following detailed description in conjunction with the accompanying drawings, wherein.

DETAILED DESCRIPTION OF THE INVENTION

Figure 1:
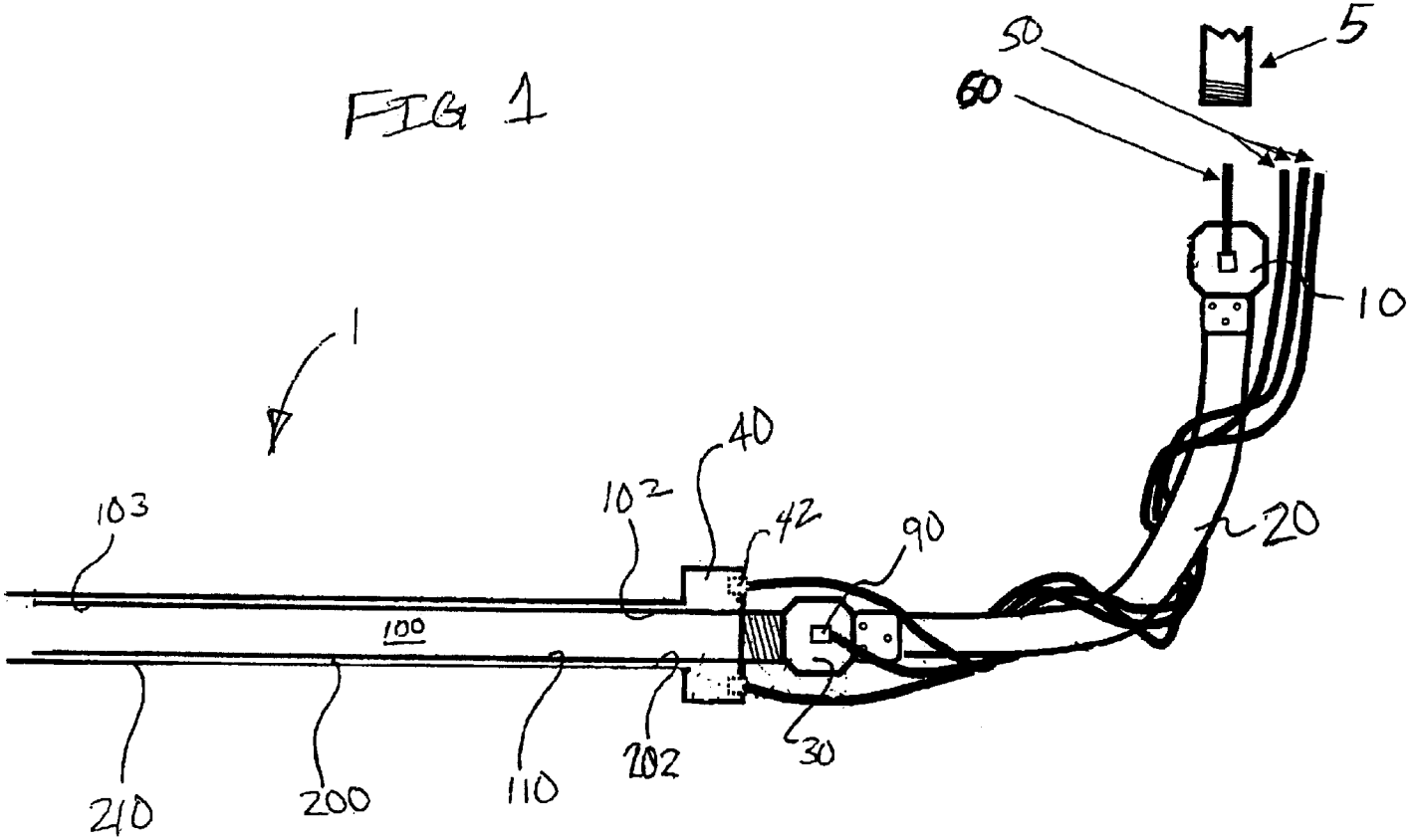
FIG. 1 is a partial sectional view of the gunning device with one nozzle embodiment according to the present invention.

As used herein, the term "drip" refers, generally, to the phenomenon that results when wet product fines separate out from the stream of a gunning material. More specifically, it includes, but is not limited to, a viscous "putty-like" build-up at the tip of the discharge end of the nozzle assembly that can fall down from the gunning material being projected onto the target substrate, thus adversely effecting the quality of the application. Also included in this definition is a second type of "drip" phenomenon which results when fines settle out from a gunning nozzle stream along the inside wall of the nozzle assembly, producing a less viscous "drip" that is projected from the nozzle assembly at a lower velocity such that it creates material waste since it does not reach the target substrate.

As used herein the term "rebound" refers, generally, to the occurrence when a gunning material does not adhere to the target substrate, e.g., because it is poorly wet or not entrapped by more fully wet gunned mass. This also includes, but is not limited to, instances of aggregate deflection which generally occurs when aggregate contained in the material bounces off a targeted surface and/or when the gunning material falls off of the target substrate during or immediately after the gunning material is applied to the targeted substrate causing a lower adhesion percentage of the gunning material to the furnace wall.

According to the present invention a gunning device is provided for applying materials such as monolithic refractories to a surface such as an interior wall surface of a furnace, preferably while the furnace is still heated. Additionally, the present invention provides a nozzle for a gunning device that more uniformly mixes a material with water and conveys the mixed material onto a target surface. In particular, it has been discovered that the gunning device of the present invention increases the degree and thoroughness of contact between the powdery material and the water and improves irregular and/or poor mixing and improved the consolidation of the gunning stream, thereby reducing "drip," the occurrence of a "split" non-homogenous stream, and "rebound." By reducing these problems, the adhesion percentage of the gunning material is improved to produce a lining body having improved density and improved strength, relative to conventional application equipment and methods, thereby enhancing the quality and durability of an applied mass.

The invention is best understood by reference to the accompanying drawings in which like reference numbers refer to like parts. It is emphasized that, according to common practice, the various dimensions of the apparatus and the associated component parts as shown in the drawings are not to scale and have been enlarged for clarity.

Referring now to the drawings, shown in FIG. 1, is an apparatus for the gunning of a material including a nozzle 1 having an inner passage 100 having an inlet end 102 into which a wetted material is to be introduced and an outlet end 103 from which the material is to be gunned. An outer passage 200 is disposed around the inner passage 100 that is in fluid communication therewith, the outer passage 200 having an inlet end 202 for introducing a gas to be passed through the outer passage 200 and impinged on the wetted material passing through the inner passage 100. The inner passage 100 is preferably defined by an inner tubular member 110 and the outer passage 200 is defined by an outer tubular member 210 disposed around the inner tubular member 110.

Sequentially attached to the nozzle 100 are a mixing chamber 30, a material delivery hose 20, and a water inlet 10, all of which are in fluid communication and through which a material is fed, preferably, being supplied pneumatically by a transporting pipe 5 that attaches to the water inlet 10. Water inlet 10 is connected to a water source 60 that provides water to wet the material to form a "gunning" material that is passed through the material delivery hose 20 to mixing chamber 30.

Mixing chamber 30 is disposed intermediate to and in fluid communication with material delivery hose 20 and nozzle 1. More specifically, mixing chamber 30 is in fluid communication with the inlet end 102 of the inner passage 100 of nozzle 1 and a source of mixing gas. The mixing gas is preferably provided by at least one gas inlet 90 for injecting gas onto the flow of the gunning material. More preferably, the gas inlet 90 includes a ring of horizontally oriented gas injection ports which impinge a flow onto the material to cause additional mixing of the material and water.

In operation, the pneumatically driven gunning material exits mixing chamber 30 and is projected into inlet end 102 and out of outlet end 103 of inner tubular member 110 onto a target substrate (not shown). The inner tubular member 110 defining inner passage 100 is from about 4 inches to about 30 feet. Preferably, the inner tubular member 110 defining inner passage 100 is from about 12 inches to about 36 inches in length and is in fluid communication with the mixing chamber 30 and, preferably, attached by a threaded nipple as shown. Preferably, the outer passage 200 is an annular space that is defined by the inner tubular member 110 being disposed concentrically within the outer tubular member 210.

According to a first nozzle embodiment, outer tubular member 210 defining the outer passage 200 is longer than the inner tubular member 110 defining the inner passage 100, as shown in FIG. 1. The outer tubular member 210 is located such that the outer passage 200 extends beyond the outlet end 103 of the inner tubular member 110, preferably, from about ¼ inch to about 12 inches.

Figure 2:
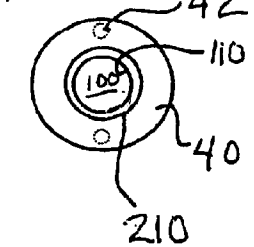
FIG. 2 is an end view of the outlet end of the nozzle shown in FIG. 1.

Preferably, nozzle 1 further comprises a hollow flange 40 disposed around the inlet end 102 of the inner passage 100. Shown in FIG. 2 is an end view of hollow flange 40 as viewed looking at the outlet end 103 of the inner tubular member 110. The hollow flange 40 includes at least one gas inlet 42 that connects the inlet end 202 of the outer passage 200 with a source of the gas to be impinged on the wetted material.

In this fashion, a controlled gas injection can be provided through the outer passage in which gas flows through the outer passage, reaches the outlet end, and acts to consolidate the stream of gunning material as it leaves the outlet end of the inner tubular member 110 allowing for lower material waste and better quality application. As shown in FIG. 1, preferably, pneumatic lines 50 are provided which supply a source of air to gas inlets 42, 90.

Figure 3:
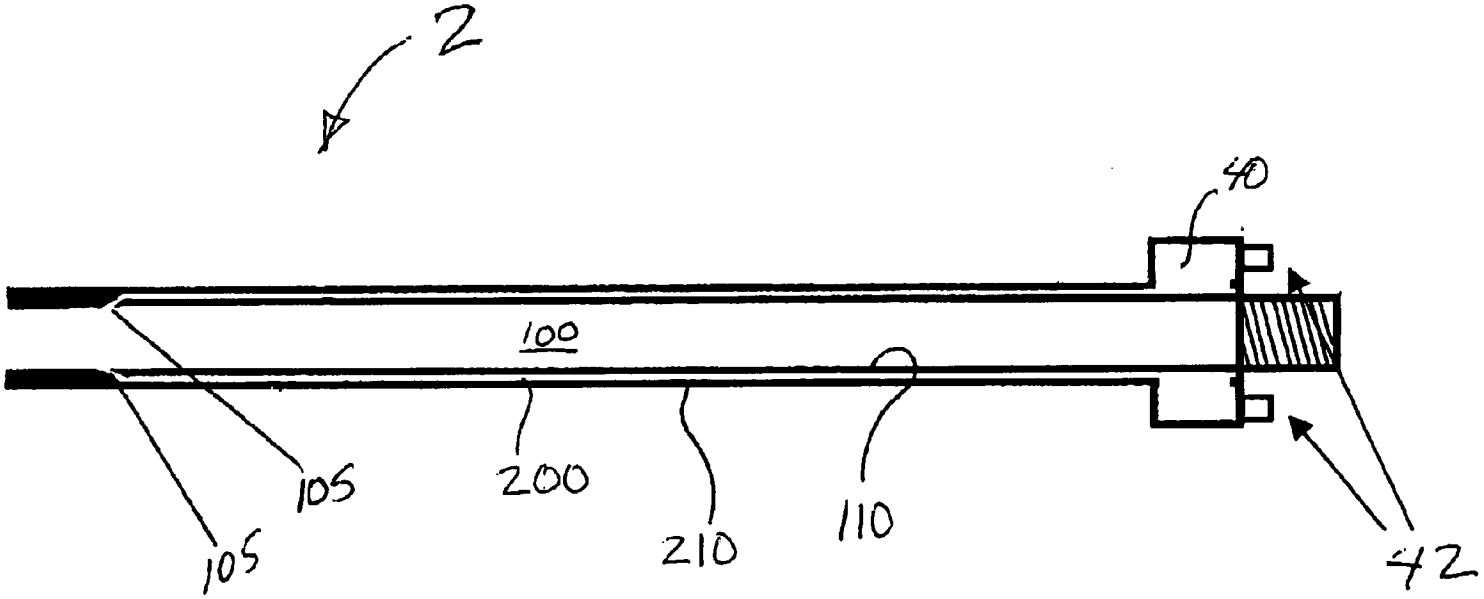
FIG. 3 is a sectional view of an alternate nozzle embodiment according to the present invention.
Figure 4:
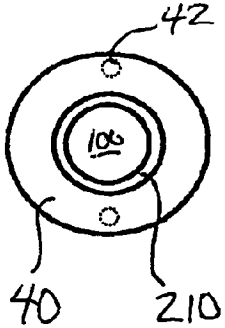
FIG. 4 is an end view of the outlet end of the nozzle of FIG. 3.

According to another embodiment of the present invention, shown in FIG. 3 is an alternate embodiment of a nozzle 2 according to the present invention, wherein the inner tubular member 110 comprises at least one opening 105 through and near its outlet end, thereby connecting the inner and outer passages of the nozzle. Preferably, at least one opening is at an angle from about 5 degrees to about 90 degrees with respect to a longitudinal axis of the inner tubular member 110 to force the gas being passed through the outer passage to be projected into the inner passage at an angle as it enters the stream of gunning material. In this fashion, the spray of the gunning material is controlled as it exits the outlet end of the nozzle and more precise gunning and a reduction in drip and rebound are provided. Shown in FIG. 4 is an end view of a hollow flange 40 as viewed looking at the outlet end of nozzle 2.

Figure 5:
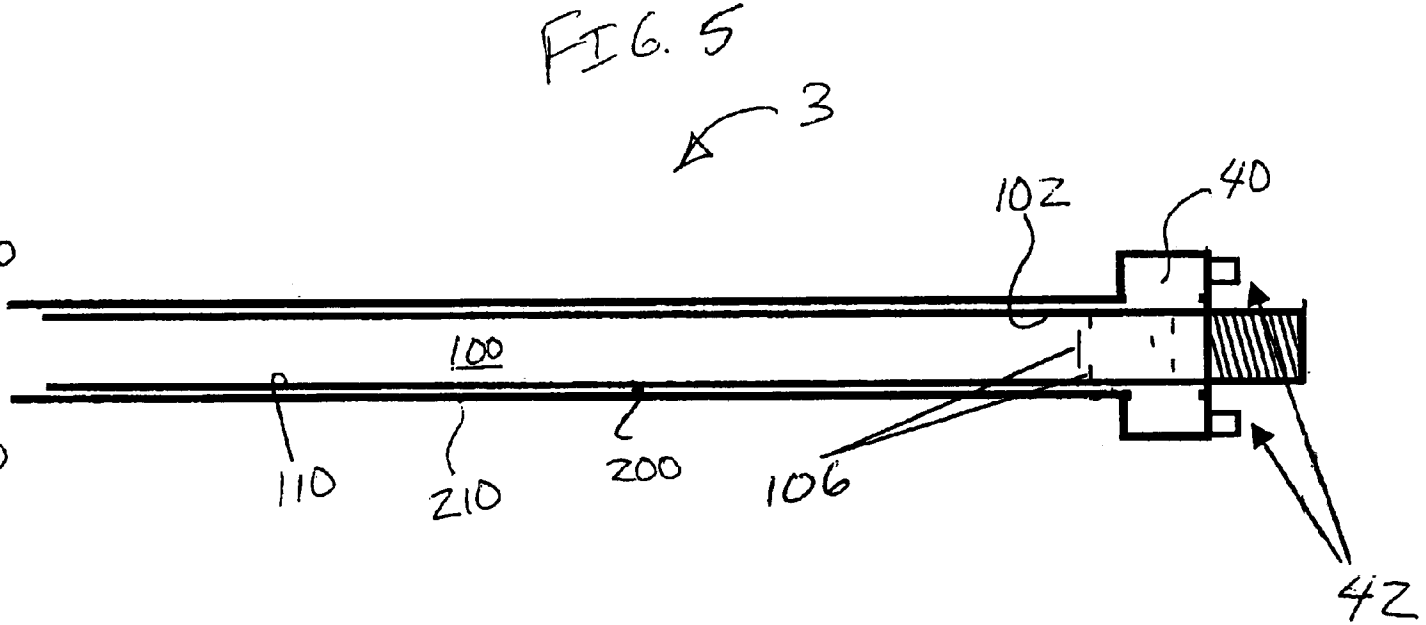
FIG. 5 is a sectional view of an alternate nozzle embodiment according to the present invention.
Figure 7:
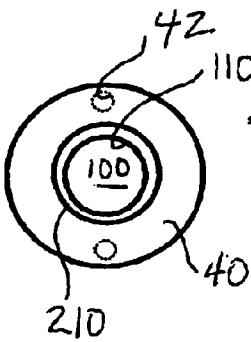
FIG. 7 is an end view of the outlet end of the nozzle shown in FIG. 5.
Figure 6:
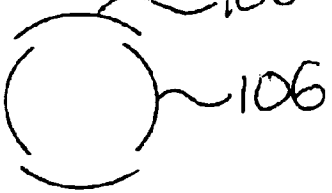
FIG. 6 is a schematic representation illustrating a preferred overlapping orientation of the ends of circumferential slots located in the nozzle shown in FIG. 5.

According to another embodiment of the present invention, shown in FIG. 5 is yet another embodiment of a nozzle 3 according to the present invention, wherein a plurality of through slots 106 is located circumferentially in the inner tubular member 110 near the inlet end 102. These slots may be located at any position within the inner tubular member. Shown in FIG. 6 is a schematic representation illustrating a preferred overlapping orientation of the ends of each of the circumferential slots 106. Shown in FIG. 7 is an end view of hollow flange 40 as viewed looking at the outlet end of nozzle 3.

Figure 8:
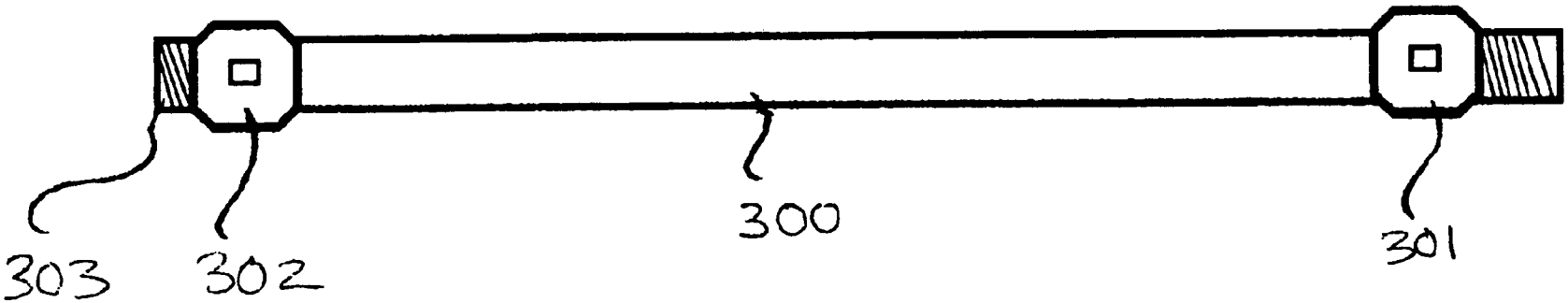
FIG. 8 is a view of an alternate gunning device embodiment according to the present invention.

FIG. 8 illustrates yet another embodiment of an apparatus for the gunning of a material according to the present invention in which a tubular member 300 is used in conjunction with a gas mixing chamber 301 located at the inlet end of the tubular member 300 and a gas inlet chamber 302 is located at an outlet end 303 of the tubular member. The combination of the mixing chamber 301 and the gas inlet chamber 302 acts to enhance the mixing and consolidation of the material and water prior to reaching the outlet end. The tubular member 300 can be used in conjunction with any of the nozzles described above attached at its outlet end 303 or alternately may be attached to a narrowed tip, thereby constricting the gunning material as it exits the nozzle.

While embodiments and applications of this invention have been shown and described, it will be apparent to those skilled in the art that more modifications are possible without departing from the inventive concepts herein described. It is understood, therefore, that the invention is capable of modification and therefore is not to be limited to the precise details set forth. Rather, various modifications may be made in the details within the scope and range of equivalents of the claims without departing from the spirit of the invention. It is envisioned that this apparatus can be used in the shotcrete method of material placement. It is also envisioned that this apparatus can be used in applications outside of those for fabricating or repairing refractory linings.

What is claimed is:

1. An apparatus for the gunning of a material comprising:

a nozzle having an inner and outer passage wherein the inner passage has an inlet end into which a wetted material is to be introduced and an outlet end from which the material is to be sprayed and wherein the inner passage is defined by an inner tubular member in which the inner tubular member comprises at least one opening through and near its outlet end thereby connecting the inner passage with an outer passage and wherein at least one opening is a plurality of through slots located circumferentially in the inner tubular passage near the inlet end; and an outer passage wherein the outer passage is defined by an outer tubular member disposed around the inner tubular member and in fluid communication therewith, the outer tubular member having an inlet end for introducing a gas to be passed through the outer passage and impinged on the wetted material passing through the inner passage.

2. The apparatus according to claim 1, wherein the nozzle further comprises a hollow flanged end disposed around the inlet end of the inner passage, the hollow flanged end having at least one air inlet port that connects the inlet end of the outer passage with a source of the gas to be impinged on the wetted material.

3. The apparatus according to claim 1, wherein the nozzle further comprises a hollow flanged end disposed around the inlet end of the inner passage, the hollow flanged end having multiple air inlet ports that connect the inlet end of the outer passage with a source of the gas to be impinged on the wetted material.

4. The apparatus according to claim 1, wherein the outer tubular member defining the outer passage is longer than the inner tubular member defining the inner passage, the outer tubular member being located such that the outer passage extends beyond the outlet end of the inner passage.

5. The apparatus according to claim 1, wherein the at least one opening is at about a 30 degree angle with respect to a longitudinal axis of the inner tubular member.

6. The apparatus according to claim 1, further comprising a mixing chamber in fluid communication with the inlet end of the inner passage.

7. The apparatus according to claim 6, wherein the mixing chamber is in fluid communication with a source of mixing gas.

8. An apparatus for the gunning of a material comprising:

a material delivery hose for providing a material; a water inlet in fluid communication with the material delivery hose for providing water to wet the material;

a nozzle for outputting the wetted material wherein the nozzle comprises an inner passage wherein the inner passage is defined by an inner tubular member having an inlet and outlet end and an outer passage defined by an outer tubular member having an inlet and outlet end and disposed around the inner tubular member, the inner tubular member having a hollow flange at the inlet end and at least one inlet port that connects it to the inlet end of the outer tubular member, the inner tubular member additionally containing a plurality of through slots located circumferentially near the inlet end and the inner tubular member and further having at least one opening through and near its outlet end thereby connecting the inner and outer tubular members of the nozzle, the outer tubular member having an inlet end for introducing a gas to be passed through the outer passage and impinged on the wetted material passing through the inner passage; and a mixing chamber disposed intermediate and in fluid communication with the material delivery hose and the nozzle and having at least one inlet for introducing a mixing gas.

9. The apparatus according to claim 8, wherein the water inlet comprises a ring of at least one water injection port.

10. The apparatus according to claim 8, wherein the inner passage is defined by an inner tubular member and the outer passage is defined by an outer tubular member disposed around the inner tubular member.

11. The apparatus according to claim 8, wherein the outer tubular member defining the outer passage is longer than the inner tubular member defining the inner passage, the outer tubular member being located such that the outer passage extends beyond the outlet end of the inner passage.

12. The apparatus according to claim 8, wherein the at least one opening is about a 30 degree angle with respect to a longitudinal axis of the inner tubular member.

13. The apparatus according to claim 10, further comprising a mixing chamber in fluid communication with the inlet end of the inner passage.

14. The apparatus according to claim 13, wherein the mixing chamber is in fluid communication with a source of mixing gas.

15. The apparatus according to claim 8, further comprising a gas inlet chamber disposed intermediate and in fluid communication with the nozzle and the inner passage outlet and having at least one inlet for introducing a gas.

* * * * *